US008627623B2

(12) United States Patent
Leonard

(10) Patent No.: US 8,627,623 B2
(45) Date of Patent: Jan. 14, 2014

(54) MODULAR FOUNDATION SYSTEM AND METHOD

(76) Inventor: Michael Leonard, Hagerstown, MD (US)

( * ) Notice: Subject to any disclaimer, the term of this patent is extended or adjusted under 35 U.S.C. 154(b) by 95 days.

(21) Appl. No.: 13/203,302

(22) PCT Filed: Feb. 25, 2010

(86) PCT No.: PCT/US2010/025460

§ 371 (c)(1),
(2), (4) Date: Aug. 25, 2011

(87) PCT Pub. No.: WO2010/099354

PCT Pub. Date: Sep. 2, 2010

(65) Prior Publication Data

US 2012/0005976 A1 Jan. 12, 2012

Related U.S. Application Data

(60) Provisional application No. 61/155,233, filed on Feb. 25, 2009.

(51) Int. Cl.
*E02D 5/74* (2006.01)

(52) U.S. Cl.
USPC ..... 52/293.2; 52/294; 52/584.1; 52/585.1; 52/745.21; 52/745.1

(58) Field of Classification Search
USPC ..... 52/294, 296, 284, 285.2, 584.1, 585.1, 52/583.1, 79.9, 79.14, 600, 223.7, 223.11, 52/293.2, 295; 404/6, 7, 9
See application file for complete search history.

(56) References Cited

U.S. PATENT DOCUMENTS

| | | | | | |
|---|---|---|---|---|---|
| 1,924,801 | A * | 8/1933 | Olmsted | 52/236.8 |
| 4,565,044 | A * | 1/1986 | Takahara | 52/745.01 |
| 4,569,167 | A * | 2/1986 | Staples | 52/92.2 |
| 4,605,336 | A * | 8/1986 | Slaw, Sr. | 404/6 |
| 4,656,797 | A * | 4/1987 | Marquart | 52/169.12 |
| 4,694,629 | A * | 9/1987 | Azimi | 52/611 |
| 4,806,044 | A * | 2/1989 | Duckett | 404/6 |
| 5,048,243 | A * | 9/1991 | Ward | 52/167.4 |
| 5,283,999 | A * | 2/1994 | Cooney et al. | 52/583.1 |
| 5,286,136 | A * | 2/1994 | Mandish et al. | 404/6 |
| 5,584,151 | A * | 12/1996 | Abou-Rached | 52/293.2 |
| 5,761,862 | A * | 6/1998 | Hendershot et al. | 52/271 |
| 6,076,319 | A * | 6/2000 | Hendershot et al. | 52/271 |
| 6,301,851 | B1 * | 10/2001 | Matsubara | 52/430 |
| 6,767,158 | B1 * | 7/2004 | Consolazio et al. | 404/6 |
| 7,669,333 | B2 * | 3/2010 | van Rijn | 29/897.34 |

FOREIGN PATENT DOCUMENTS

| | | | |
|---|---|---|---|
| JP | 01029525 A | * | 1/1989 |
| JP | 2-308042 | * | 12/1990 |
| JP | 3-267421 | * | 11/1991 |
| JP | 04027023 A | * | 1/1992 |

(Continued)

*Primary Examiner* — Robert Canfield
(74) *Attorney, Agent, or Firm* — Stuart J. West; Shaun N. Sluman; West & Associates, A PC

(57) ABSTRACT

A modular foundation system comprising prefabricated foundation sections each comprising stems and bases. In some embodiments, the base of each section is configured to have complimentary ends adapted to selectively engage in a desired configuration. In some embodiments, each base and/or each stem of each section can include coupling openings adapted to receive engagement reinforcing adapted to engage adjacent sections. Each section includes a clamping bracket adapted to selectively couple with an alignment rod adapted to draw adjacent sections together and align said adjacent sections.

18 Claims, 8 Drawing Sheets

(56) References Cited

FOREIGN PATENT DOCUMENTS

| | | | | |
|---|---|---|---|---|
| JP | 04030049 | A | * | 2/1992 |
| JP | 05017957 | | * | 1/1993 |
| JP | 5-132955 | | * | 5/1993 |
| JP | 60257165 | A | * | 9/1994 |
| JP | 06306873 | A | * | 11/1994 |
| WO | 2010/099354 | A2 | * | 9/2010 |

* cited by examiner

MODULAR FOUNDATION SYSTEM AND METHOD

CLAIM OF PRIORITY

The following application claims priority to U.S. Provisional Patent Application No. 61/155,233, filed Feb. 25, 2009, the complete contents of which are hereby incorporated by reference.

BACKGROUND

1. Field of the Invention

The invention relates generally to building foundations and more specifically to modular foundations.

2. Background

Typical building foundations are constructed either as complete or partially monolithic, cast-in-place structural elements. Due to the continuity requirements for both adequate structural response and to meet code requirements, construction of foundations is typically accomplished with as few joints within the foundation as possible. Such construction requires a significant amount of in-field manual labor to construct intricate rebar cages and mount the rebar cages on dobe blocks to ensure minimum concrete cover and correct location of rebar within the cast-in-place concrete foundation. During the pouring of the concrete and the vibration of the concrete during and after the pour, the rebar cages can become dislodged and rebar may, after the pour and vibration, be accurately placed within the foundation. Additional site-pour problems include concrete quality issues, air entrainment problems, section adhesion problems and improper vibration leading to excess settling.

Additionally, conventional systems and methods are generally designed almost exclusively for use with gravel ballast footers. Moreover, an inherent weakness of conventional site-pour foundations is that the quantity of steel reinforcement that can be used is limited by patterns/structural design.

What is needed is a modular foundation system that offers simple field assembly of the modules, accurate alignment of foundation modules and accurate placement of rebar within the shop-fabricated modules.

DETAILED DESCRIPTION

Figures 1, 1A:
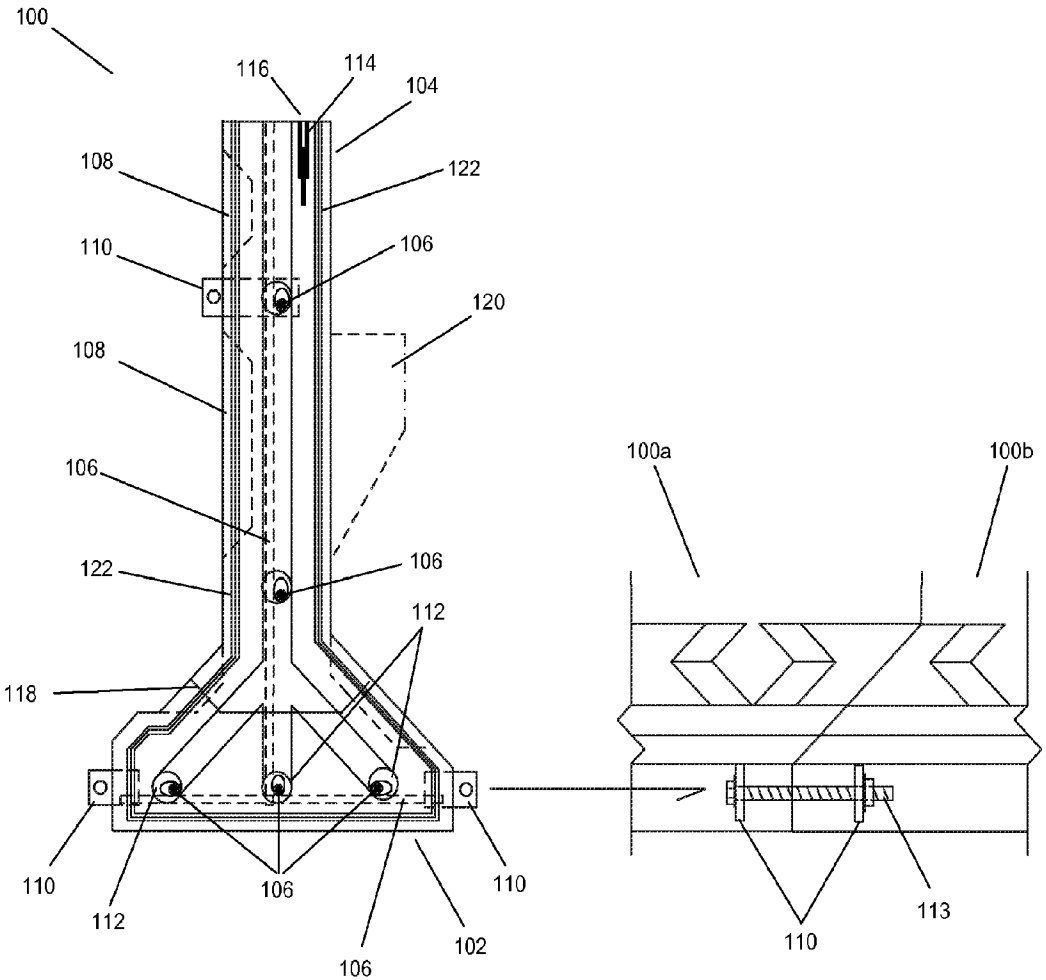
FIG. 1 depicts an end view of a modular foundation section.
FIG. 1*a* depicts a side view of two modular foundation sections coupled together and held in place by draw/clamp brackets and a threaded rod.

FIG. 1 depicts an end view of a modular foundation section 100. In the embodiment depicted in FIG. 1, the modular foundation section 100 includes a base section 102 and a stem section 104. In the embodiment depicted in FIG. 1, the base 102 is depicted as having a truncated, substantially triangular cross-sectional shape and the stem 104 is depicted as having a substantially rectangular cross-section. However, in alternate embodiments the base 102 and/or stem 104 can have any known and/or convenient geometry.

In some embodiments the foundation section 100 can be formed of any known and/or convenient concrete mix design having any known and/or convenient strength and/or containing any known and/or convenient additives. However, in alternate embodiments, any known and/or convenient material can be used to form the foundation section 100. In still other embodiments, a foundation section 100 can be comprised of recycled and/or environmentally-friendly material.

In the embodiment depicted in FIG. 1, a base 102 and a stem 104 can include vertical and horizontal reinforcing bars 106 and/or other reinforcement as desired and/or required by any building code. In some embodiments, reinforcing bars 106 can have any known and/or convenient geometry and/or can be comprised of any know and/or convenient material, and a base 102 and/or stem 104 can have any desired number of bars 106 in any other desired configuration.

In the embodiment depicted in FIG. 1, the interior and/or exterior faces of a base 102 and/or stem 104 can include embedded patterns 108 that can be designed to reduce the weight of a foundation section 100 without significant and/or any impact on the structural performance of the section 100. In the embodiment shown, embedded patterns 108 can stabilize and/or lock a foundation section 100 in place within soil. In alternate embodiments, a section 100 can include extruded patterns, post and beam-formed apertures, and/or portions designed to otherwise increase structural integrity. Patterns 108 can have waffle, octagonal and/or diamond configurations, and/or can have any other known and/or convenient geometry. Moreover, in still alternate embodiments the cross-section of each section 100 may not be uniform and can have any known, convenient and/or desired variation.

Referring to FIG. 1, draw/clamp brackets 110 can be coupled with a section 100 and can be used to bring two sections 100 together and hold them in place for a desired amount of time. In some embodiments, brackets 110 can be used for alignment, clamping and/or permanent bolting. Additionally, in some embodiments, a bracket 110 can be used in conjunction with a threaded rod 113 (see FIG. 1A). As shown in FIG. 1, a base 102 can include interior and exterior draw/clamp brackets 110, and the interior of a stem 104 can also or alternatively include a draw/clamp bracket 110. In alternate embodiments, draw/clamp brackets 110 can be located in any desired quantity on any surface of the section 100. In some embodiments, brackets 110 can be utilized in any section 100 for hurricane, storm, or earthquake connections as dictated by building codes.

In the embodiment depicted in FIG. 1, draw/clamp brackets 110 can be comprised of steel embedded within a section 100. However, in alternate embodiments, the draw/clamp brackets 110 can be comprised of any known and/or convenient material or combination of materials and can be coupled with a section 100 in any other known and/or convenient manner. In some embodiments, draw/clamp brackets 110 can be either flat or angled stock.

In the embodiment depicted in FIG. 1, the ends of a section 100 can include coupling openings 112 adapted to receive bonding dowels or bars 106 that can be adapted to structurally connect adjacent sections 100. In the embodiment depicted in FIG. 1, the coupling openings 112 can have a truncated conical shape tapered towards the interior of the section 100. However, in alternate embodiments coupling openings 112 can have any other desired size and/or geometry. In the embodiment depicted in FIG. 1, the base 102 is depicted as including three coupling openings 112 and the stem is depicted as including two coupling openings 112. However, in alternate embodiments any known and/or convenient number of coupling openings 112 can be included in the base 102 and/or stem 104.

In the embodiment depicted in FIG. 1, a stem 104 can include embedded anchor bolts and/or connectors 114 adapted to engage a desired superstructure and/or anchor bolt openings 116 adapted to receive and couple with anchor bolts and/or connectors 114. Anchor bolts 114 and/or openings 116 can be located at any desired spacing along the top surface of the stem 104 and/or at any desired location along the height of a section 100.

A base 102 and a stem 104 can be separate components and/or can each be comprised of multiple coupled components. As shown in FIG. 1, the base 102 and/or a stem 104 can include one or more separation planes 118 that can allow complete or partial separation of a base 102, stem 104 and/or any sub-component of either a base 102 and/or stem 104, such that the segments can be re-bonded. Thus, in some embodiments the sections can be installed as components and bonded in place. In other embodiments, a base 102 and stem 104 can be pre-fabricated as one unit.

In some embodiments, the exterior surface and/or interior surface of a stem 104 and/or base 102 can include one or more attachment members 120 adapted to facilitate attachment of facade material and/or masonry veneer to a section 100. In some embodiments, one or more ends of a base 102 and/or stem 104 can comprise alignment sections 122 that can facilitate proper alignment when two or more sections 100 are coupled together. As described below, alignment sections 122 can further comprise a tongue section 308 and groove section 310.

FIG. 1A depicts a side view of two modular foundation sections 100*a* 100*b* coupled together and held in place by draw/clamp brackets 110 and a threaded rod 113. As described in detail below, a plurality of sections 100 can be held together by a bracket 110-rod 113 system either temporarily, such as when allowing bonding material to set and/or cure, or permanently, depending on the specific construction application and work parameters.

Figure 2:
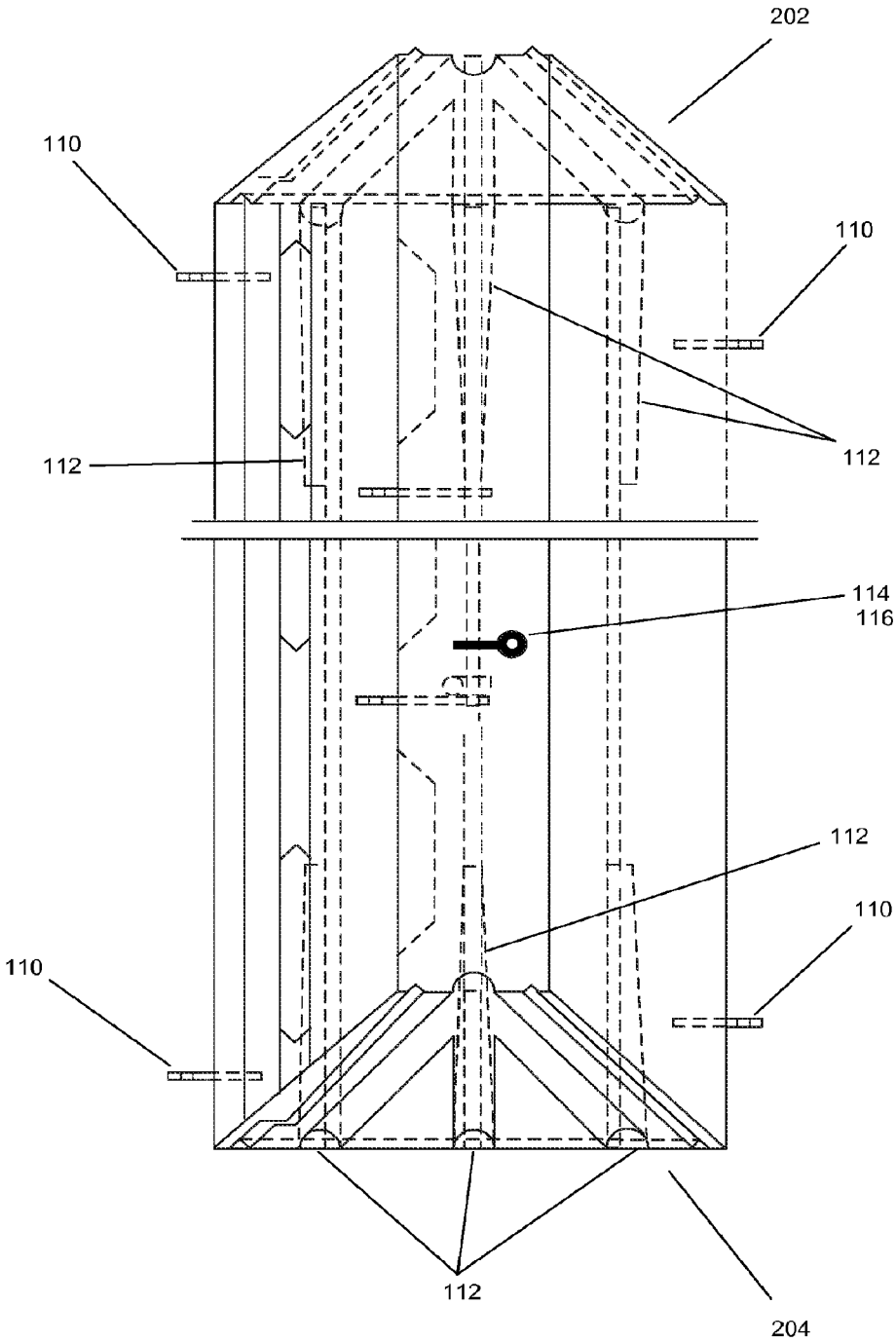
FIG. 2 depicts a top view of a modular foundation section.

FIG. 2 depicts a top view of the embodiment of a modular foundation section 100 depicted in FIG. 1. A section 100 can have two ends 202 204. The base 102 of the first end 202 of a section 100 can be tapered in a truncated pyramidal formation and the base 102 of a second end 204 can recessed in a complimentary truncated pyramidal formation, such that an adjacent section 100 can be selectively aligned and mated when complimentary ends are brought proximal to each other. In alternate embodiments, the bases 102 and/or stems 104 of each end 202 204 of a section 100 can have any desired complimentary configuration such that at least two sections can be aligned based upon the geometry of the respective ends 202 204.

In operation, tapered dowel openings 112 can perform three functions: 1) when two sections 100 are manipulated into place the dowels can operate as an alignment tool; 2) as sections 100 near mating the dowels can be compressed closer to cast rebar 106; and 3) the tapered geometry can allow for air to escape when grout is poured into openings 112. Additionally, in some embodiments liquid grout poured into openings 112 can bind rebar in concrete for code compliance.

Figure 3:
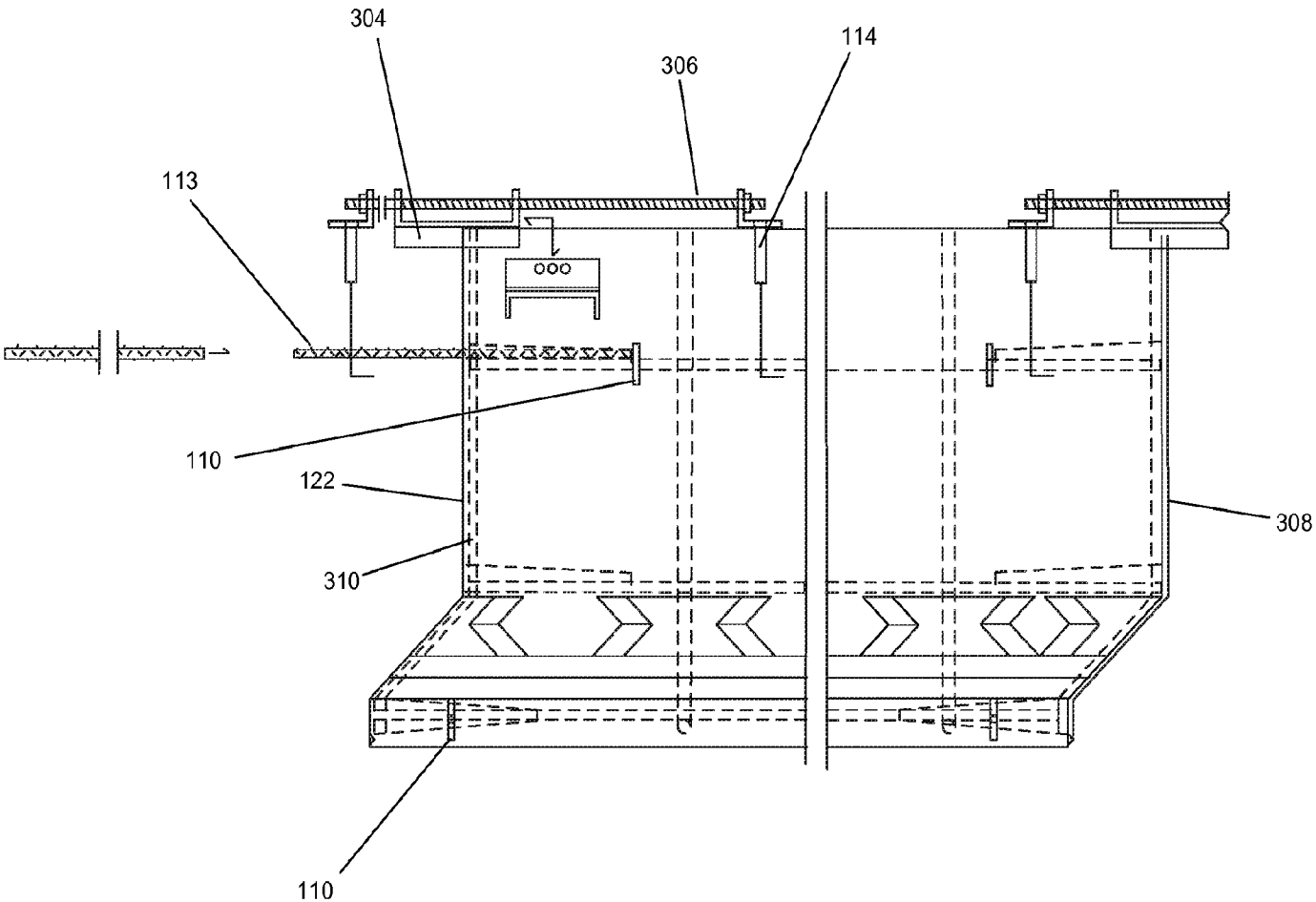
FIG. 3 depicts an exterior view of a modular foundation section.

FIG. 3 depicts an elevation view of the exterior of the section 100 depicted in FIGS. 1-2. In the embodiment depicted in FIG. 3, the ends 202 204 of the section have complimentary truncated angled shapes. In the embodiment depicted in FIG. 3, embedded anchor bolts 114 can be embedded within a section 100 and provide a positive connection mechanism for attachment of the section 100 to any desired superstructure or element. Additionally, alignment sections 122 can further comprise complimentary tongue 308 and groove 310 portions, which can be angular or square in nature, or can have any other known and/or convenient geometry.

In some embodiments, dowels 106 and coupling openings 112 can act as the primary alignment mechanism, and mating tongue 308 and groove 310 alignment sections 122 in each module 100 can act as secondary alignment tools. Additionally, a top saddle 304 and bottom clamps 110 can refine alignment. In some embodiments, tongue 308 and groove 310 may not be exact fits, but they can have close tolerance fits allowing compressed epoxy to ooze from this point as desired.

Figure 4:
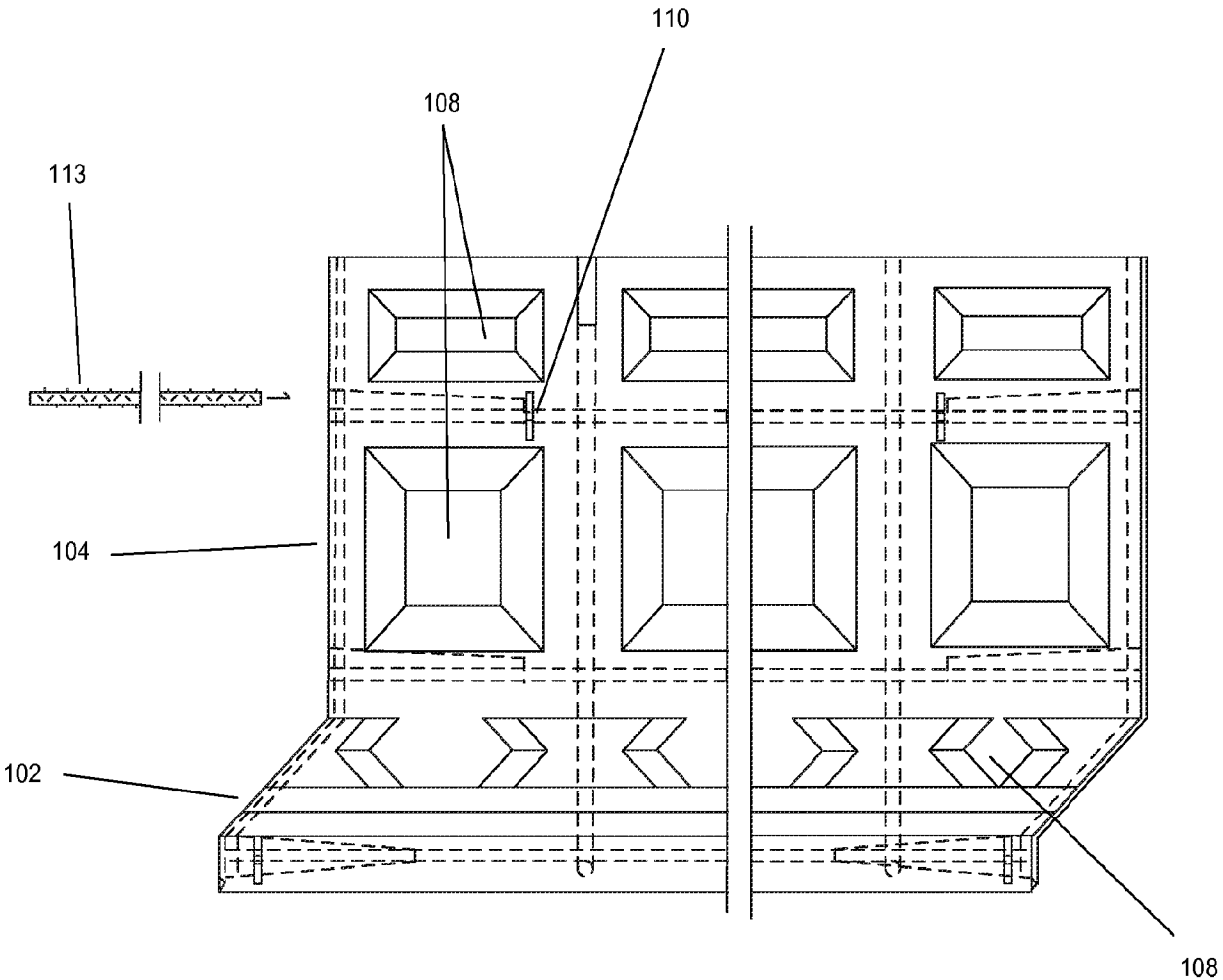
FIG. 4 depicts an interior view of a modular foundation section.

FIG. 4 depicts an interior elevation of the section depicted in FIGS. 1-3. In the embodiment depicted in FIG. 4, the interior surfaces of the stem 104 and base 102 include octagonal and diamond shaped depressions. In alternate embodiments, any desired surface enhancement can be employed and/or the surface can have any desired texture and/or roughness and/or smoothness. Additionally, coatings and/or additives can be employed to protect concrete systems from pH problems and/or any other know and/or discovered environmental condition.

FIGS. 5-9 depict embodiments of various corners and intersections having the same alignment and bonding properties as depicted and described with regards to FIGS. 1-4. Thus, in operation, a united foundation can be constructed from individual sections 100 that can be prefabricated to have any desired structural and/or physical properties.

Figure 5:
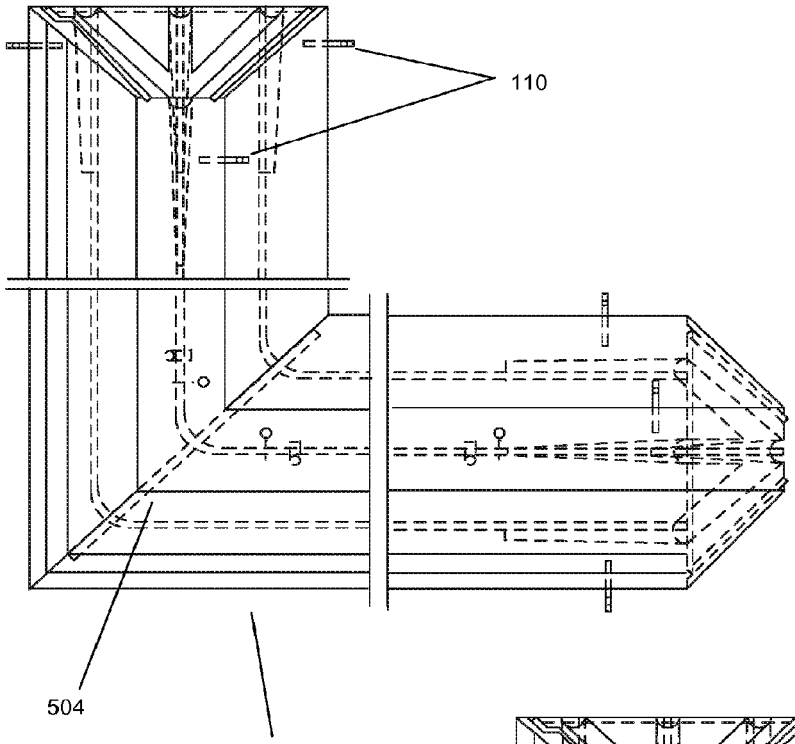
FIG. 5 depicts an inside corner connection of a modular foundation section.
Figure 6:
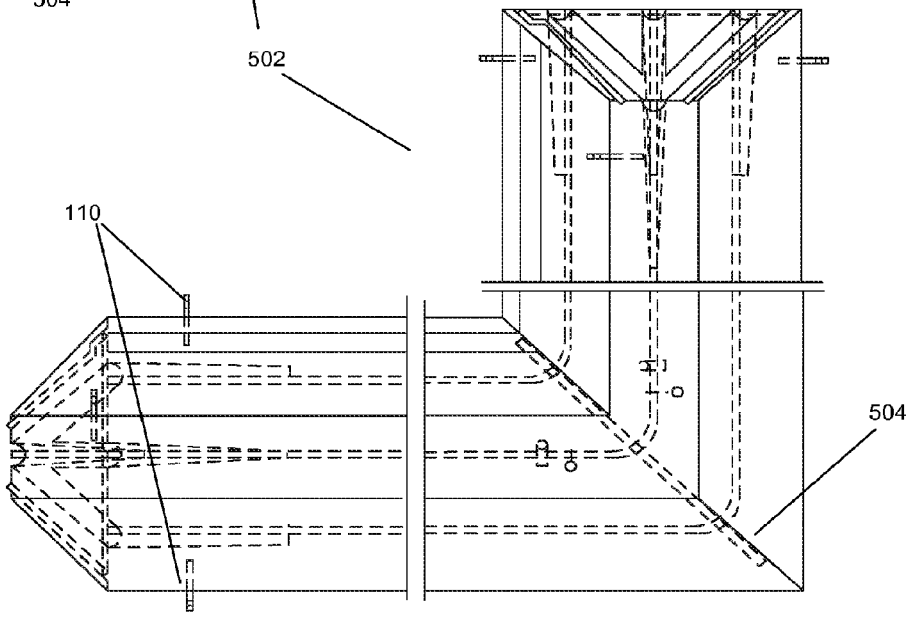
FIG. 6 depicts an outside corner connection of a modular foundation section.

FIGS. 5 and 6 depict inside and outside corner sections 502, respectively, comprising elements similar to those described in FIGS. 1-4 with respect to sections 100. In some embodiments, a corner section 502 can comprise diagonal rebar supports 504 to further strengthen the section.

Figure 7:
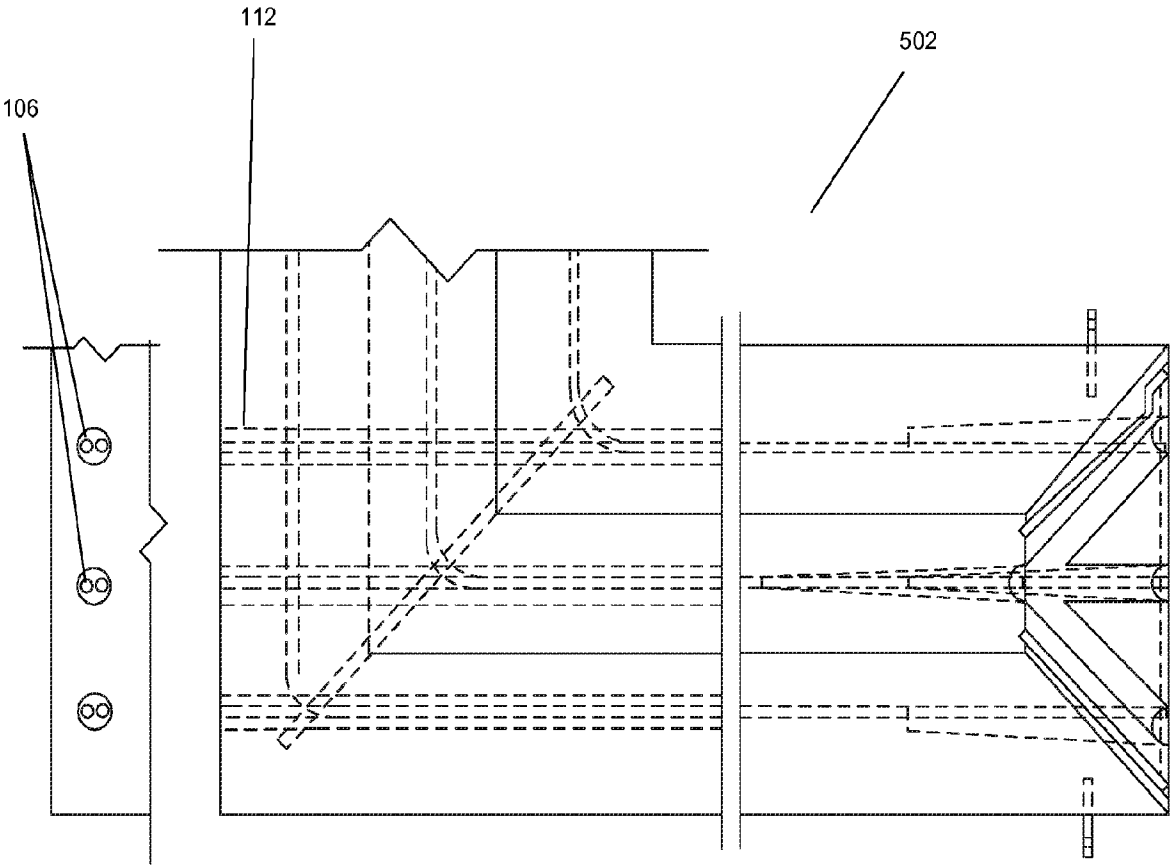
FIG. 7 depicts a closing corner connection of a modular foundation.

FIG. 7 depicts one embodiment of an outside closing corner 502 comprising a plurality of coupling openings 112 on its exterior. Rebar 106 can be inserted into openings 112 such that an outside closing corner 502 can mate with another section 100, corner 502, or pivoting section 900 (described below).

Figure 8:
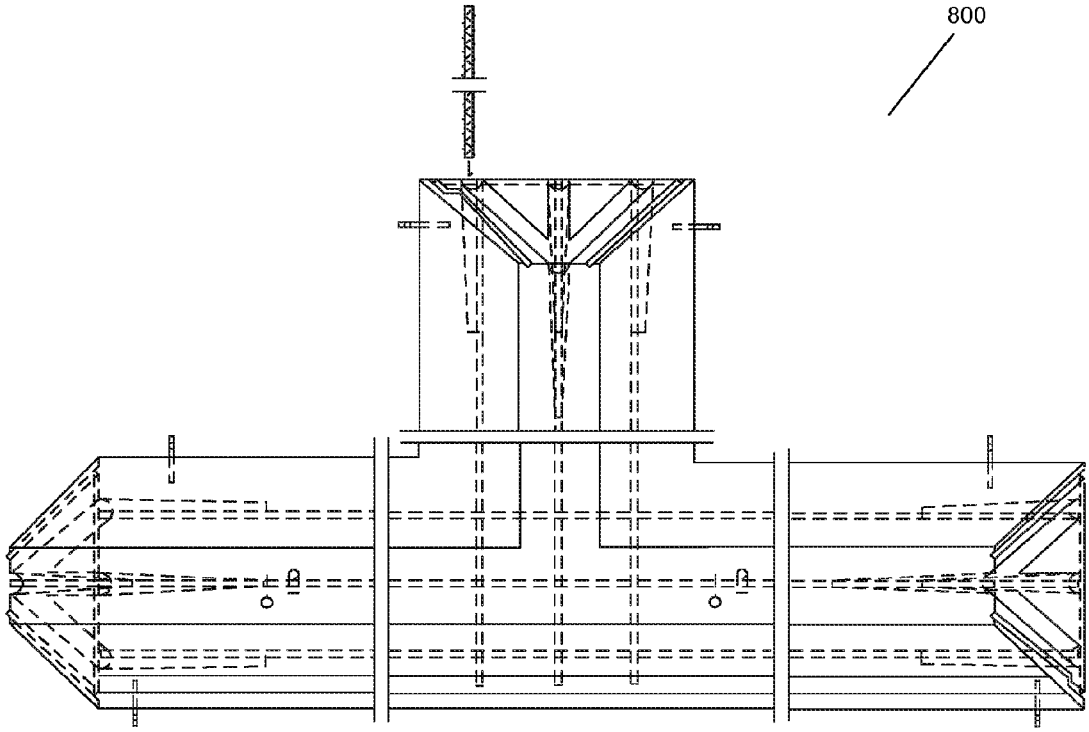
FIG. 8 depicts a "T" connection of a modular foundation.

FIG. 8 depicts one embodiment of a tee section 800 that can be mated with additional sections 100.

Figure 9A:
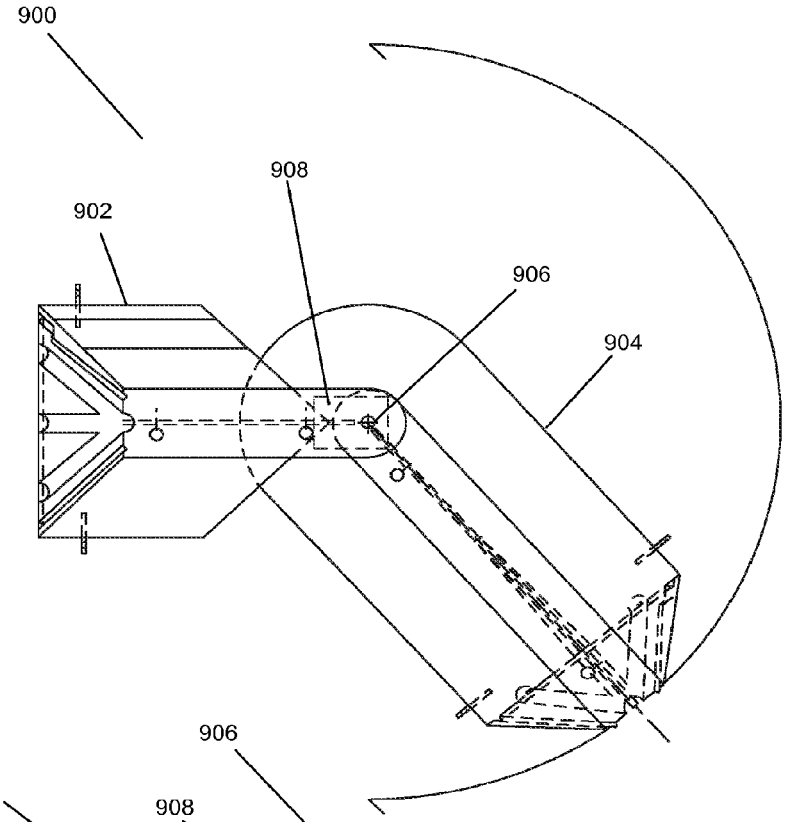
FIG. 9*a* depicts a top view of an adjustable, pivoting modular foundation section in an angled configuration.

FIG. 9A depicts a top view of an adjustable, pivoting modular foundation section 900 in an angled configuration. A pivoting modular foundation section 900 can comprise a first section 902 and a second section 904 coupled via a hinge mechanism 906. In the embodiment depicted, a section 904 can pivot up to 180 degrees about a hinge 906 with respect to a section 902. In other embodiment, sections 902 904 can have any other known and/or desired degree-of-rotation properties. As shown in FIG. 9A, portions of sections 902 904 can be curved and/or rounded, where necessary and/or desired, proximate to a hinge mechanism 906 such that sections 902 904 can pivot without interfering with each other.

Figure 9B:
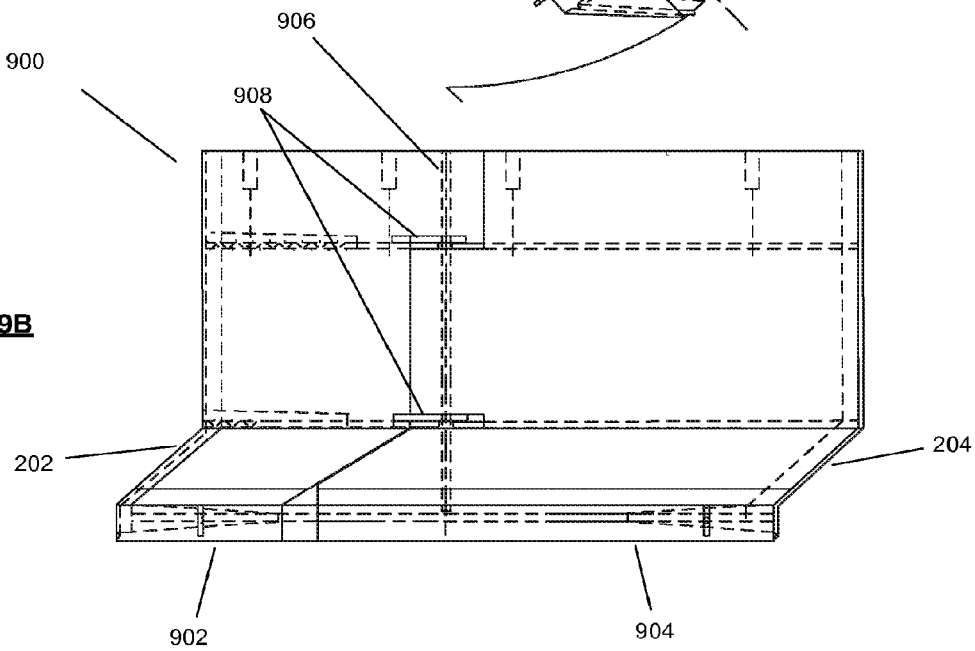
FIG. 9*b* depicts a side view of an adjustable, pivoting modular foundation section.

FIG. 9B depicts a side view of an adjustable, pivoting modular foundation section 902. A hinge mechanism 906 can be positioned such that sections 902 904 can rotate about a substantially vertical axis. In other embodiments, a hinge mechanism 906 can be placed in any other known and/or convenient configuration and sections 902 904 can pivot in any other known and/or convenient manner.

In some embodiments, section 902 and/or 904 can further comprise at least one embedded steel plate 908, to provide strength and ease motion, proximate to a hinge mechanism 906. As depicted in FIGS. 9A-9B, two steel plates 908 can lie in a substantially horizontal plane; however, in other embodiments, sections 902 and/or 904 can have any known and/or convenient number of steel plates 908 and/or plates 908 can be in any other known and/or convenient configuration and/or location. In some embodiments, a foundation section 900 can further comprise at least one cavity proximate to a hinge mechanism 906 and plates 908 such that, once a section 900 is set in its final resting position on site, the cavity can be filled with mortar, concrete, grout, epoxy or any other known and/or convenient material that can harden and lock sections 902 904 in place, preventing further movement/rotation.

The following describes one embodiment of a method for using the elements described in FIGS. 1-9B. On site, a site excavator can line and excavate the area within which a foundation is to be constructed. Utilizing a site laser level, the excavator can distribute dirt and/or gravel evenly so as to create a suitable, even plane upon which the foundation system is to be permanently set. Once the ground surface is ready for the foundation, a pre-fabricated corner section 502 can be set into place and stabilized with ground spikes. Dowels 106 can be inserted into openings 112 of the corner section 502 and tapped into place with a hammer. Slow set concrete epoxy, or any other known and/or convenient bonding material, can then be applied along an alignment section 122 on one end of a corner section 502 and within coupling openings 112. Epoxy can also be applied within coupling openings 112 of a modular foundation section 100. With dowels 106 inserted and epoxy applied, a second modular foundation section 100 can be hoisted into place and coupled with dowels 106 and alignment sections 122. Vibratory techniques may or may not be employed, as desired. When sections 502 100 are hoisted together, they can be further aligned and coupled via alignment saddles 304 and/or brackets 110.

At least one threaded rod 113 can be placed through draw/clamp brackets 110 located on each section 502 and 100 and can be employed to draw the two adjacent sections together to form a unified section. An alignment rod 306 can be similarly placed through alignment saddles 304 at the top of sections 502 100 and employed to draw the sections together. Brackets 110 and saddles 304 can subsequently be removed and additional sections 100 can be added. Alternatively, brackets 110 and saddles 304 can remain in place for several hours or days, to allow epoxy to cure, and then removed.

This process can be repeated and additional foundation sections 100 and/or 502 can be installed into the open trench in sequence according to factory specifications. When all sections 100 and corner sections 502 are in place, a corner pivoting section 900 can be installed. A first section 902 of a pivoting modular foundation section 900 can be coupled with a section 100 in the manner described above. A second section 904 can then be rotated about a hinge 906 and coupled with the remaining open-ended section 100. A second section 904 can be mated with a section 100 in the manner described above. Additionally, bonding agent can be applied to any cavities located proximate to a hinge mechanism 906 such that the section 900 can be locked into place. Finally, mortar or any other desired material can be applied to the interior and/or exterior unfinished surfaces of a closing corner 900.

In some embodiments, the material applied to alignment sections 122, openings 112, and/or any other portion of a foundation assembly can be non-shrink grout, concrete epoxy, and/or any other known and/or convenient bonding agent. Additionally, as will be evident to one of ordinary skill in the art, the installation of the system described herein can be installed with minimal ground disturbance. Moreover, in some embodiments, foundation sections 100, 502, and/or 900 can be fabricated with rigid insulation.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A modular foundation system comprising:

a plurality of prefabricated foundation sections, each of said plurality of prefabricated foundation sections comprising a stem and a base;

wherein the base of each prefabricated foundation section has complimentary ends, each complimentary end being adapted to selectively engage in a desired configuration with a complimentary end of the base of a different prefabricated foundation section;

wherein the base and the stem of each prefabricated foundation section each define one or more coupling openings adapted to receive one or more engagement reinforcing members at least partially into the interior of said prefabricated foundation section, said engagement reinforcing members being adapted to couple adjacent prefabricated foundation sections together; and wherein each prefabricated foundation section comprises at least one clamping bracket on the exterior of said prefabricated foundation section, said clamping bracket being adapted to at least temporarily couple with an alignment rod adapted to draw adjacent prefabricated foundation sections together and align said adjacent prefabricated foundation sections.

2. The modular foundation system of claim 1, wherein the complementary ends of a particular prefabricated foundation section are a recessed area in one end of the base and a protrusion extending from the other end of the base.

3. The modular foundation system of claim 2, wherein the recessed area and the protrusion are each substantially pyramidal.

4. The modular foundation system of claim 1, wherein said clamping bracket is selectively removable from the exterior of said prefabricated foundation section.

5. The modular foundation system of claim 1, wherein said coupling openings are at least partially conical shaped areas recessed into the interior of the prefabricated foundation section.

6. The modular foundation system of claim 1, wherein the base of a particular prefabricated foundation section has a substantially triangular cross section.

7. The modular foundation system of claim 1, wherein the base of a particular prefabricated foundation section is selectively removable from the stem of the particular prefabricated foundation section.

8. The modular foundation system of claim 1, wherein at least one of said plurality of prefabricated foundation sections is straight.

9. The modular foundation system of claim 1, wherein at least one of said plurality of prefabricated foundation sections is an L-shaped corner section.

10. The modular foundation system of claim 1, wherein at least one of said plurality of prefabricated foundation sections is a T-shaped joint section.

11. The modular foundation system of claim 1, wherein at least one of said plurality of prefabricated foundation sections is a pivoting prefabricated foundation section comprising a first section pivotally coupled with a second section with a hinge, such that the first section and the second section are configured to rotate relative to one another about the hinge.

12. A method of modular foundation construction, comprising:

positioning a first prefabricated foundation section and a second prefabricated foundation section substantially end to end, wherein each of said first and second prefabricated foundation sections comprises a base and a stem extending from said base, and wherein each end of said base is configured to selectively engage with a corresponding end of a different prefabricated foundation section;

inserting a reinforcement, member into a coupling opening in said first prefabricated foundation section and a coupling opening in said second prefabricated foundation sections, such that said reinforcement member extends at least partially through both the interior of said first prefabricated foundation section and the interior of said second prefabricated foundation section;

applying a bonding material within the coupling openings of both said first and second prefabricated foundation sections around said reinforcement member;

extending an alignment member into a clamping bracket on the exterior of both said first and second prefabricated foundation sections;

aligning said first and second prefabricated foundation sections by tightening said alignment member to bring the clamping brackets of both said first and second prefabricated foundation sections closer together;

allowing said bonding material to cure such that said first prefabricated foundation section is permanently coupled with said second prefabricated foundation section.

13. The method of modular foundation construction of claim 12, further comprising:

removing said alignment rod after said bonding material has cured.

14. The method of modular foundation construction of claim 12, further comprising:

removing said clamping brackets from said first and second prefabricated foundation sections after said bonding material has cured.

15. The method of modular foundation construction of claim 12, wherein said bonding material is slow set concrete epoxy.

16. The method of modular foundation construction of claim 12, further comprising:

applying said bonding material to at least one end of said first or second prefabricated foundation section between said first and second prefabricated foundation sections prior to alignment.

17. The method of modular foundation construction of claim 12, wherein an end of the base of said first prefabricated foundation section has a recessed area configured to receive a protrusion at the corresponding end of the base of said second prefabricated foundation section.

18. The method of modular foundation construction of claim 12, wherein at least one reinforcement member is inserted into coupling openings in the stems of said first and second prefabricated foundation sections, and at least one reinforcement member is inserted into coupling openings in the bases of said first and second prefabricated foundation sections.

* * * * *